US005651185A

United States Patent [19]

Vanderheyden et al.

[11] Patent Number: 5,651,185

[45] Date of Patent: Jul. 29, 1997

[54] ARCHERY BOW SIGHT

[76] Inventors: Carl Vanderheyden, 2620 Bellevue St., Green Bay, Wis. 54311; Howard M. Sweeney, 1112 LaCount Rd., Green Bay, Wis. 54313

[21] Appl. No.: 600,496

[22] Filed: Feb. 13, 1996

[51] Int. Cl.[6] ..... F41G 1/467

[52] U.S. Cl. ..... 33/265; 124/87

[58] Field of Search ..... 33/265, 334, 252, 33/253, 254, 247, 248, 260, 391; 124/86, 87, 88

[56] References Cited

U.S. PATENT DOCUMENTS

| | | | |
|---|---|---|---|
| 2,925,656 | 2/1960 | Genovese | 33/265 |
| 3,521,362 | 7/1970 | Duplechin | 33/265 |
| 3,787,984 | 1/1974 | Bear et al. | 33/265 |
| 4,580,349 | 4/1986 | Webb et al. | 33/265 |
| 5,001,837 | 3/1991 | Bray | 33/265 |
| 5,092,052 | 3/1992 | Godsey | 33/265 |
| 5,092,053 | 3/1992 | Roberts | 33/265 |
| 5,359,780 | 11/1994 | Dallaire | 33/265 |

*Primary Examiner*—G. Bradley Bennett
*Attorney, Agent, or Firm*—Basil E. Demeur; Alan B. Samlan

[57] ABSTRACT

There is disclosed an improved archery bow sight assembly formed by a main sight body having a forward body portion and rear body portion. The forward body portion includes a series of sight attachment slots in which a plurality of stationary sight pins may be mounted. The rear body portion is formed as a curvilinear slotted sight guide, and accommodates a moveable peep sight to travel throughout the path of travel thereof. The rear moveable peep sight is mounted on a sight arm which is pivotally secured to the main sight body, and is in meshing engagement with a sight adjustment lever similarly pivotally secured to the main sight body. The sight adjustment lever includes a finger control ring which permits the archer to move the sight adjustment lever by a single finger control which, in turn, will move the sight arm carrying the peep sight along the path of the curvilinear slotted sight guide. The forward stationary sight pins are mounted at different preselected yardage distances such that the archer may sight a target via the forward movable peep sight via the forward stationary sight pin, and to the target. Hence, the sight assembly permits the user to sight the target by using a two-point sighting system while still permitting the sighting procedure to be accomplished while the bow is drawn to full draw without requiring the archer to adjust his hand positions when at full draw.

15 Claims, 2 Drawing Sheets

FIG. 1
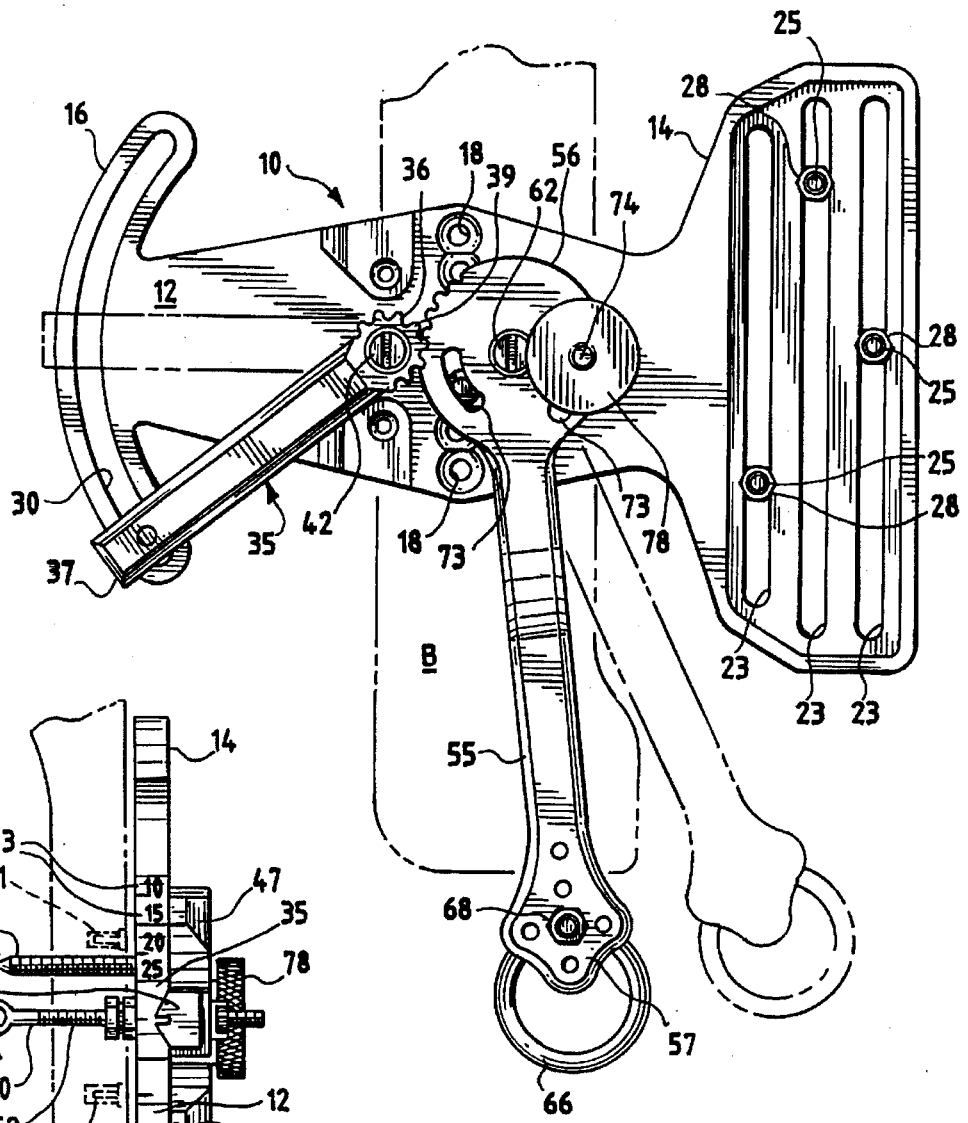
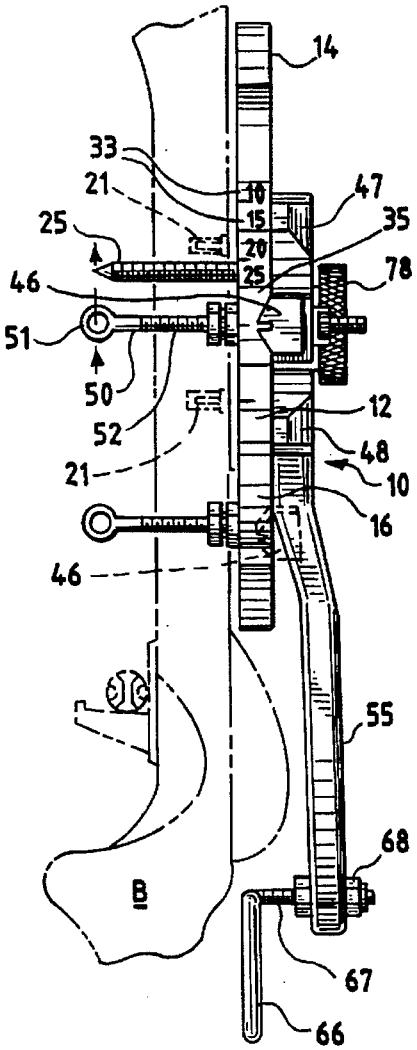
FIG. 2

ARCHERY BOW SIGHT

BACKGROUND OF THE INVENTION

The present invention relates to an improved sight assembly for an archery bow which is intended to provide a more accurate sighting system for an archer.

The sight system provided by the present invention is particularly intended for use as a bow-riser mounted adjustable peep sight system for an archery bow. It is specifically designed to replace the bow string mounted type peep sight. The present prior art for sights for archery bows generally provides what is referred to as a string-mounted peep sight. The string-mounted peep sight usually takes on various shapes and designs, however, the general type is a disk designed with a peep hole in the center, which is then attached to the bow string by attachment means which attaches between the many strands that make up the bow string and secured in place to line up with the user's eye at full draw. Another variation of a string-mounted sight consists of a rubber disk which is mounted in position so as to rest in the corner of the mouth of the user when at full draw. However, such bow string sights provide many disadvantages when in actual use. For example, a string peep sight is generally unpredictable in that it is usually never in the proper viewing position when at full draw. This is especially so since the bow string-mounted peep sight, due to its method of attachment, often turns in different directions when the user pulls the bow to a full bow draw. Further, such bow string peep sights may easily become clogged with various debris and therefore hampers the user's ability to use the sight when necessary and required. An even more prevalent draw back to such sights is the fact that a string peep is difficult to view through during low light conditions. Hence, conditions such as at dusk, does not give the user sufficient capability to manipulate the bow to pull it to full draw, and then view through the peep sight to target in order to make an accurate shot. It is well-known that it is typical to use archery bows at just such times, that is during low light conditions, for the ideal hunting conditions. As such, such peep sights present serious draw backs to the accurate sighting of a bow.

Efforts to overcome such difficulties have been manifested in the prior art. For example, a bow sight assembly is disclosed in U.S. Pat. No. 5,359,780 which is directed to a bow sight assembly which includes a range finder and is mounted on the bow. The sight pin is mounted on a sight arm which in turn is designed to rotate about a pivot in direct proportion to the movement of a vertical member which is connected to range finder. The archer sights the target by manipulating the vertical member while sighting the sight pin onto the target. The range finder at the top of the device will then indicate a range to target. This device, however, represents a sight which provides only a single sight pin and therefore requires that the archer sight the pin directly to the target while manipulating the vertical arm until a supposed accurate sight is made. Hence, a one-position sight is provided, but the one position consists of the one forward sight pin which is moveable by the archer, and sights directly to the the target. It has been found that such sight assemblies are less than accurate and capable of error.

Another archery bow sight assembly is described in U.S. Pat. No. 5,001,837 which is directed to a sight assembly which is designed for mounting onto the bow. This device includes a range finder and a peep sight all mounted to a forwardly extending sight assembly, with the peep sight being moveable by means of an arm carrying a lower finger control at the bottom. The device is constructed as a parallelogram such that the movement of the peep sight will move the range finder which is located on the top portion of the unit until a range is determined to target. It is clear from the description that the entire sight assembly is moved forwardly of the bow since it is mounted on a bracket, which is in turn mounted to the bow. This is intended to provide an adjustability feature. It will be noted, however, that the entire sight assembly includes numerous moving parts, and still provides only a single peep through which the archer will view the target in order to sight the range. It will further be noted that the use of the device requires that once the archer sights the target, that a locking bolt with a handle is then utilized to lock the parallelogram sub-assembly into a fixed orientation in order to "lock on the target." It has been found that manipulating such a sight assembly is difficult for the archer, and requires several hand manipulations in order to sight the target. Further, it is difficult to lock the unit into position once the archer is at full draw. In summary, the sight assembly as described therein provides a sight assembly which has a moveable forward peep sight as the sole sight means for sighting a target.

Still another adjustable bow sight is disclosed in U.S. Pat. No. 5,092,052, which is intended for mounting to a bow and intended to provide a moveable peep sight for sighting the target. The device described therein provides a bracket mountable to a bow handle, and includes a forwardly moveable peep sight as disclosed in the drawing. It is apparent from the description of this device that the archer would move a rear lever throughout a curvilinear track, which then translates motion to the forward moveable peep sight along a vertical track such that the rotary movement of the rear lever translates to vertical movement of the peep sight. Once again, this sight provides a single peep sight for sighting a target and requires the archer to use a single sight window or peep sight for sighting the target. Further, the moveable portion of the sight is located on the forward end of the sight assembly, and is therefore further removed from the eye of the archer.

Numerous other attempts have been made in the prior art to improve the sight assemblies for an archery bow previously described with regard to bow string sights, and other fixed sight assemblies, intended for mounting to an archery bow. It is clear from the above-noted three prior art patents that each was intended to be an improvement over a number of other prior art patents cited therein.

The present archery bow sight assembly is intended as an improvement over the structures disclosed hereinabove.

OBJECTS AND ADVANTAGES

The present archery bow sight is intended to provide a sight assembly which is basically simple in configuration, and attempts to eliminate as many moving parts as possible while nevertheless providing an improved bow sight for sighting a target. The present sight assembly provides a two-pin sight assembly wherein the rear sight is a peep sight and is moveable by the archer, and sights through a forward stationary sight pin, to target. In this manner, a two-pin sight assembly is provided which therefore more accurately locates the range or distance to target than any of the single pin sight assemblies heretofore discussed.

The principal object of the present invention is therefore to provide a two-pin sight assembly wherein the rear pin sight is a moveable peep sight, and the forward sight is a stationary sight pin, permitting the user to sight through the peep sight which is moveable until the forward stationary sight pin and target are in view and to then be able to read a range to target from the sight assembly.

In conjunction with the foregoing object, it is a further object to provide an improved sight assembly of the type described which further permits the archer to mount a plurality of forwardly mounted stationary sight pins onto the sight assembly, and to then be able to sight a target by sighting through the rear peep sight via one of the plurality of forwardly mounted sight pins, to target, and to be able to do the above while at full draw and without moving the archer's hand once at full draw.

In conjunction with the foregoing objects, the present invention provides a sight assembly of the type described, which operates by means of a rearwardly mounted peep sight mounted onto a moveable sight arm, the sight arm being moveable in response to the movement of a sight adjustment lever which is provided with a finger ring which accommodates the user to simply move the lever and the corresponding sight arm by a single finger control, and to sight the peep sight onto a stationary sight pin and to target to provide a more accurate shot.

Still in conjunction with the foregoing objects, a further object is to provide a sight assembly of the type described wherein the rearward portion of the sight assembly is provided with range indicia or distance scale and a pointer located on the sight arm, such that once the target is properly sighted, the archer is capable of reading a range to target directly from the distance scale provided.

Further features of the invention pertain to the particular arrangement of the parts whereby the above-outlined and additional operating features thereof are attained.

The invention both as to its organization and method of operation, together with further objects and advantages thereof will best be understood by reference to the following specification taken in connection with the accompanying drawings.

SUMMARY OF THE INVENTION

In summary, the present invention is intended to provide an improved archery bow sight assembly which provides a two-pin sight system for sighting a target. Further, the present invention is intended as an improved sight assembly by providing a sight assembly wherein the rear sight is the peep sight and is moveable in response to the user's manipulation of a sight adjustment lever and permits the user to sight through the moveable peep sight via a forward stationary sight pin and onto the target thereby to provide a more accurate sighting of the target at full draw. The present improved sight assembly further provides a sight assembly which eliminates complicated mechanical parts, such as parallelogram sub-assemblies, for simplicity, while nevertheless improving the sighting capability of the sight assembly. Further, by providing a rearwardly attached moveable peep sight, the peep sight is positioned at a more useable focal distance from the eye of the user and is therefore easily useable during low light condition given the proximity of the peep sight to the user's eye.

Further advantages of the improved sight assembly of the present invention will be understood by reference to the further description of the sight assembly described in conjunction with the accompanying drawings.

BRIEF DESCRIPTION OF DRAWINGS

FIG. 1 is a side elevational view illustrating the improved bow sight assembly mounted onto a typical archery bow;

FIG. 2 is a rear elevational view showing the two-pin sight method of the present invention and the adjustability of the rear peep sight relative to the forward stationary sight pin.

DETAILED DESCRIPTION OF DRAWINGS

Figure 3:
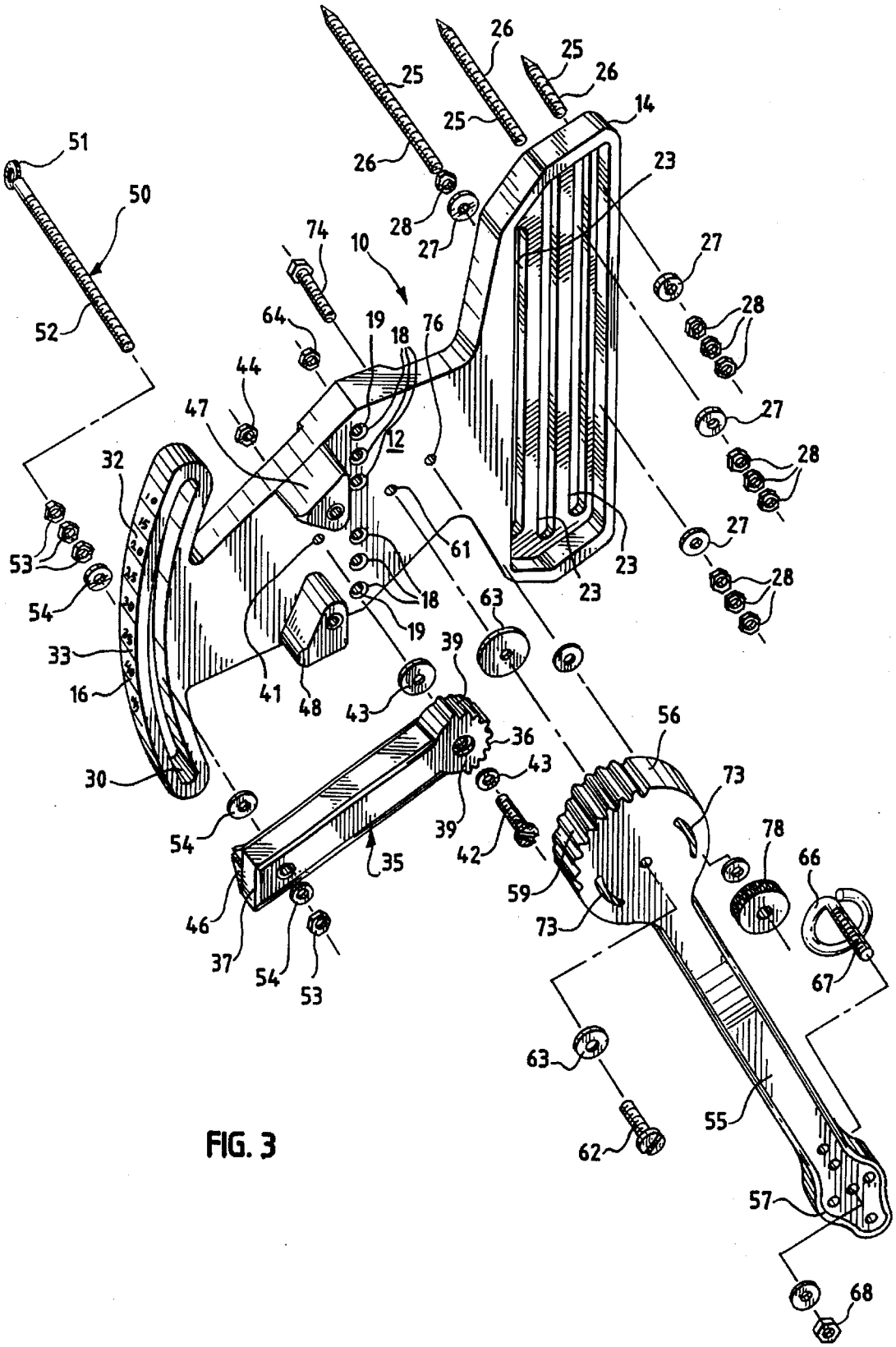
FIG. 3 is an exploded perspective view showing the manner in which the elements of the sight assembly of the present invention are connected in cooperative engagement.

With reference to FIG. 1 of the drawings, the improved sight assembly is generally illustrated at numeral 10. It will be observed that the sight assembly 10 includes a main sight body 12 having a forward body portion 14 and a rear body portion 16. Located substantially intermediate the forward body portion 14 and rear body portion 16 is a plurality of attachment apertures 18 which are utilized for attaching the sight assembly 10 to a typical archery bow B. It will be noted that each of the attachment apertures 18 is surrounded by a chamfer 19 which allows for the bolt heads of the attaching bolts 21 to be recessed relative to the main body portion 12 to insure that the bolt heads are recessed so as not to interfere with the rotational movement of the sight adjustment lever 55 as will be more fully described hereinafter.

The forward body portion 14 is shown, in the preferred embodiment, to be vertically elongate in configuration, and provided with a plurality of sight attachment slots 23 formed therein. The sight attachment slots 23 permit the user to install and mount one or more of a plurality of sight pins 25 in the slots 23 at preselected positions there along in a manner and for a purpose to be more fully described hereinafter. It will be noted that the sight pins 25 are threaded as indicated at 26 thereby to accommodate one or more washers 27 and nuts 28 to be screw-threaded thereon in order to accomplish the mounting of the sight pins 25 into the slots 23. As shown in FIG. 3 of the drawings, the washers 27 and nuts 28 may be screw-threaded onto the sight pins 25 on both sides of the slots 23 in order to securely mount the sight pins 25 through the slots 23.

The rear body portion 16 is shown to be formed as a curvilinear slotted sight guide 30. The curvilinear slotted sight guide 30 is provided with a rear outer surface 32 which accommodates a distance scale 33 to be imprinted thereon.

The sight assembly 10 is further provided with a sight arm 35 having a front end 36 and a rear end 37. The front end 36 of the sight arm 35 is shown to be provided with a plurality of gear teeth 39 which operate to pivotally move the sight arm 35 in a manner to be more fully described hereinafter. The sight arm 35 is pivotally secured to the main sight body 12 through a mounting aperture 41 and held in position by means of bolt 42 via washers 43 and lock nut 44. The rear end 37 of the sight arm 35 is provided with a distance pointer 46 which, in use, permits the operator to read distance off of the distance scale 33. It will further be noted that the path of travel of the sight arm 35 is limited relative to the main sight body 12 by means of an upper stop boss 47 and a lower stop boss 48, each of which is fixedly secured to the main sight body 12 by appropriate bolts (not shown). It should be clear that the upper stop boss 47 and lower stop boss 48 may also be secured by means of molding the same integrally with the sight body 12, or forming or machining the same as a part of the sight body 12. This particular arrangement of the parts is clearly illustrated in FIG. 1 of the drawings.

As more particularly shown in FIGS. 2 and 3 of the drawings, the sight arm 35 is also adapted to carry a rear peep sight 50 which is formed by circular peep ring 51 and a threaded body 52. Once again, the rear peep sight 50 is mounted to the sight arm 35 by means of a plurality of lock nuts 53 and washers 54 in the manner illustrated. It will also be observed that once mounted to the sight arm 35, the rear peep sight 50 travels within the confines of the curvilinear slotted sight guide 30 thereby to be utilized by the archer for sighting a target within the distance parameters preselected by the user.

The sight assembly 10 is further provided with a sight adjustment lever 55 having a top end 56 and a bottom end 57. As particularly shown in FIGS. 1 and 3 of the drawings, the sight adjustment lever 55 is provided with a plurality of gear teeth 59 formed along the top end 56 thereof, and when in use, are intended to be in gear meshing engagement with the gear teeth 39 of the sight arm 35 (See FIG. 1). The sight adjustment lever 55 is shown to be pivotally secured to the main sight body 12 through a mounting aperture 61 by means of bolt 62 and washers 63 and held in position by lock nut 64. The bottom end 57 of the sight adjustment lever 55 is also provided with a finger ring 66 secured thereto by the cooperation of the threaded shaft 67 and the lock nut 68.

The top end 56 of the sight adjustment lever 55 is shown further to be provided with travel restrictor slot(s) 73 as shown in FIG. 1, which operate to limit the path of travel of the entire sight adjustment lever 55. Further, the travel restrictor slot(s) 73 also functions as a tension adjustment slot in which is carried threaded mounting bolt 74 which in turn passes through mounting aperture 76, and carries thereon a tension adjustment knob 78. It will be clear that the user may then adjust the tension and therefore the ease of movement of the sight adjustment lever 55 by adjusting the tension as between the sight adjustment lever 55 and main sight body 12 by adjusting tension knob 78.

From the above description, with particular reference to FIG. 1 of the drawings, it will be observed that both the sight adjustment lever 55 and the sight arm 35 are pivotally mounted onto the main sight body 12 in the manner previously indicated. In this manner, once the sight assembly 10 is mounted to the bow B, whichever hand the archer uses for grasping the bow is the hand which the archer will use to insert a finger through the finger ring 66 and control the movement of the sight adjustment lever 55. Due to the meshing gear arrangement as between the top end 56 of the sight adjustment lever 55 and the gear teeth 39 formed on the forward end of the sight arm 35, a concomitant pivotal movement of the sight arm will be achieved as the archer adjusts sight adjustment lever 55.

It will also be appreciated from the above description, that since all of the elements and parts forming the sight assembly 10 of the present invention are bolted into position, and given the configuration and construction of the main sight body 12, the sight assembly 10 of the present invention may be used on either a left-handed or right-handed bow depending on the dexterity of the user. It will be appreciated that only the sight adjustment lever 55 need be rebolted to the sight body 12 when sight body 12 is mounted on the reverse side of the bow (as shown in FIG. 3) such that a left-handed archer may similarly employ the same sight assembly 10. It is believed that this particular feature of the invention is a feature that is not prevalent with respect to other sight assemblies intended for mounting on an archery bow. This is especially true of sight assemblies which include complicated mechanical levers and movements which are not readily reversible.

In setting up the sight assembly 10 of the present invention, the archer will, as a preliminary matter, select one of a number of desired yardages to yield a parameter of distances within which the archer may choose to shoot. The sight assembly 10 is mounted to the bow B, and then the archer may install one or more stationary sight pins 25 onto the sight adjustment slots 23 located in the forward body portion 14 of the main sight body 12. Hence, the archer may, for example, preliminarily sight the bow at a yardage of ten yards, and install a stationary sight pin 25 at the ten yard mark. The ten yard mark is determined by sighting through the rear peep sight 50 onto a stationary sight pin 25 and onto a target located ten yards from the archer's position. A ten yard sight pin 25 is then bolted into place such that the distance pointer 46 located on the sight arm 35 will read ten yards on the distance scale 33 when the archer sights a target at the ten yard mark via peep ring 51 sighted through the preselected sight pin 25 for a ten yard target. The archer would then similarly pre-sight the bow for different yardages, such as for example, fifteen yards, twenty yards, etc., up through whatever distance the archer desires, and mount a stationary sight pin 25 at each preselected yardage distance. As illustrated in the accompanying drawings, a series of three sight pins 25 are shown installed in the sight adjustment slots 23, but it will be appreciated from the above description, that the archer may choose to install as many sight pins 25 as he deems necessary or desirable depending upon the shooting distance he intends to engage in during a hunt. Once the desired number of stationary sight pins 25 are bolted into position, the sight assembly 10 of the present invention permits the archer to utilize a two-pin, or two point aiming system much like that utilized for a rifle or a pistol.

It will further be appreciated that when a target is sighted, the archer may draw his bow to full draw, and then commence sighting through the peep ring 51 via a stationary sight pin 25 and read the yardage to target off of the distance scale 33 via the distance pointer 46.

The present invention further permits the use of a variety of different sized peep rings 51 since the peep ring may be screw threadedly mounted to the threaded body 52 of the rear peep sight 50. Hence, a plurality of different sized peep rings 51 may be provided depending upon the particular comfort and desire of the archer. This feature, in conjunction with the fact that the rear peep sight 50 is the moveable sight and located adjacent to the archer's eye permits a more accurate sighting of the target while giving the archer some degree of flexibility in terms of constructing the sight assembly 10 in the manner he deems comfortable.

It will also be appreciated that the construction of the sight assembly 10 of the present invention basically eliminates a number of the moving parts associated with other bow sight assemblies, and therefore simplifies the construction of the overall sight assembly. The present invention provides a sight assembly 10 which basically includes only two moving parts consisting of the sight arm 35, and the sight adjustment lever 55, when in use. Hence, the overall sight assembly has been greatly simplified, and more importantly, after simplification, still provides a sight assembly which incorporates a two-point aiming system consisting of the rear moveable peep sight 50, and a forward stationary sight pin 25. Hence, the possibility of mechanical problems with complicated mechanical sight assemblies is eliminated by having a sight assembly with two basic moving parts.

It has further been found that by adjusting the gear ratio as between the gear teeth 39 located on sight arm 35 and the gear teeth 59 located on the sight adjustment lever 55 to a gear ratio of between 2.5 to 1 and 3 to 1, and especially at a gear ration of 3.0 to 1, decreases the archers finger travel while adjusting the peep sight. Hence, the requirement of the archer to manipulate the sight adjustment lever 55 is kept to a minimum, while still permitting an accurate sighting of the target via a two-point sighting system.

It will also be appreciated that the improved archery bow sight as set forth herein may also be used in cooperation with a standard string mounted peep on the bow as well. In such an eventuallity, the bow would be provided with a three-point aiming system formed by the forward mounted sight pin, the moveable peep, and the string-mounted peep. Hence, it is possible to mount the sight of the present invention on a bow having in existance a string-mounted peep as well and further enhance the archer's ability to accurately sight the target with the sight of the present invention.

It will be appreciated from the above description that the present invention provides an improved bow sight assembly which permits the archer to utilize a two-point sighting system consisting of a rear moveable peep sight, which operates in conjunction with a forward stationary sight pin, thereby permitting the archer to sight the target through the peep ring via the stationary sight pin. Further, the stationary sight pins may be positioned along a plurality of sight attachment slots located in the forward body portion of the main sight body at any desired preselected yardage distance as determined by the archer. Once the stationary sight pins are positioned at appropriate yardage sight points, and archer may then utilize the sight assembly for shooting targets at his desired yardage distance. The sight assembly further provides a yardage measuring system by the cooperation of the distance pointer located on the sight arm, which operates in conjunction with a distance scale located on the outer surface of the rear body portion of the main sight body.

Even more importantly, the improved bow sight assembly of the present invention is constructed from a minimum of a number of moving parts such that the ease and simplicity of utilizing the sight assembly is enhanced while at the same time, providing the archer with a more accurate sighting system to target.

Furthermore, as previously indicated, the sight assembly of the present invention may be mounted on either a left-handed bow or a right-handed bow thereby eliminating the need to manufacture two variations of the same sight. While there has been disclosed what is at present considered to be the preferred embodiment of the invention, it will be understood that various modifications may be made therein and it is intended to cover in the appended claims all such modifications as fall within the true spirit and scope of the invention.

We claim:

1. An improved archery bow sight adapted for attachment to an archery bow comprising in combination, a main sight body having a forward body portion and a rear body portion forming a slotted sight guide, said main sight body having attachment means interposed between said forward body portion and said rear body portion for attaching said sight to an archery bow, a sight arm pivotally carried on said main sight body having a front end and a rear end, said front end of said sight arm provided with gear teeth for effecting movement of said sight arm, and provided with a peep sight mounted thereon adjacent the rear end of said sight arm, said peep sight adapted to travel within the confines of said slotted sight guide, a sight adjustment lever pivotally secured to said main sight body having a top end and a bottom end, said top end provided with gear teeth and said bottom end provided with finger control means, said gear teeth of said sight adjustment lever being positioned to be in meshing engagement with said gear teeth of said sight arm such that movement of said sight adjustment lever via said finger control means results in a concomitant movement of said sight arm and said peep sight, a plurality of forward stationary sight pins mounted on said forward body portion of said main sight body at preselected positions there along to provide a two-pin sighting assembly consisting of the moveable peep sight carried on said sight arm and one of said forward stationary sight pins carried on said forward body portion of said main sight body, and said rear body portion of said main sight body provided with a distance scale and said sight arm provided with a distance reader which operates in conjunction with said distance scale such that movement of said sight arm causes a concomitant movement of said peep sight until said peep sight is in alignment with a selected forward stationary sight pin and the ultimate target, thereby allowing a read out of the distance to target via the distance scale and distance reader, such that a two-pin sight assembly is provided which more accurately measures distance to target formed by a moveable rear peep sight and a forward stationary sight pin.

2. The improved archery bow sight as set forth in claim 1 above, wherein said forward body portion is provided with a plurality of slots and said forward stationary sight pins are adapted for mounting at preselected positions along the length of said slots.

3. The improved archery bow sight as set forth in claim 1 above, wherein said rear end of said main sight body is formed as a curvilinear slotted sight guide having an outer rear surface and forming a path of travel for said peep sight, moveable along the length of said curvilinear slotted sight guide in response to the movement of said sight arm.

4. The improved archery bow sight as set forth in claim 3 above, wherein said outer rear surface of said curvilinear slotted sight guide is provided with a series of distance indicia imprinted thereon and said sight arm is provided with a distance reader which operates in conjunction with said distance indicia to permit the reading of distance to target in response to the movement of said sight arm and peep sight when sighting the ultimate target.

5. The improved archery bow sight as set forth in claim 2 above, wherein each of said forward stationary sight pins are mounted at preselected positions along one of the plurality of slots to preset various preselected distances.

6. The improved archery bow sight as set forth in claim 3 above, wherein said main sight body is further provided with an upper stop boss and a lower stop boss and positioned above and below, respectively, the path of travel of said sight arm to limit the path of travel of said sight arm therebetween in conjunction with the path of travel of said peep sight along the length of the curvilinear slotted sight guide between a maximum and a minimum target distance.

7. The improved archery bow sight as set forth in claim 1 above, wherein said attachment means comprises a plurality of attachment apertures for accommodating attachment bolts to securely attach said main sight body to an archery bow.

8. The improved archery bow sight as set forth in claim 1 above, wherein said finger control means comprises a finger ring mounted at said bottom end of said sight adjustment lever to accommodate the user's finger therein and permit controlling movement of said lever with a single finger.

9. An improved archery bow sight adapted for attachment to an archery bow, comprising in combination, a main sight body having a forward slotted body portion and a rear curvilinear slotted sight guide, said main sight body further provided with attachment means to accommodate the mounting of said main sight body to an archery bow, a sight arm pivotally carried on said main sight body in operative position with said rear curvilinear slotted right sight guide, said sight arm having a front end and a rear end, said front end of said sight arm provided with gear teeth for effecting movement of said sight arm and said sight arm having a peep sight mounted adjacent the rear end of said sight arm and in an operative position with said curvilinear slotted sight guide, said peep sight adapted to travel within the confines of said curvilinear slotted sight guide, a sight adjustment lever pivotally secured to said main sight body, said adjustment lever having a top end and a bottom end, said top end provided with gear teeth and said bottom end provided with finger control means, said gear teeth of said sight adjustment lever being in operative meshing engagement with said gear teeth of said sight arm such that the pivotal movement of said sight adjustment lever via said finger control means causes a concomitant pivotal movement of said sight arm and said peep sight, a plurality of forward stationary sight pins mounted on said forward slotted body portion at preselected positions there along to provide a two-pin sighting system consisting of said moveable peep sight carried on said sight arm and one of said selected forward stationary sight pins mounted on said forward slotted body portion, a distance scale carried on the outer surface of said curvilinear slotted sight guide, said sight arm provided with a distance pointer in operative position with respect to said distance scale such that the movement of said sight arm causes a concomitant movement of said peep sight until said peep sight is in alignment with a selected forward stationary sight pin and said distance pointer is then in position to read a preselected distance from said distance scale.

10. The improved archery bow sight as set forth in claim 9 above, wherein said attachment means is interposed between said forward slotted body portion and said rear curvilinear slotted sight guide to accommodate the mounting of said main sight body onto an archery bow.

11. The improved bow sight as set forth in claim 9 above, wherein said finger control means comprises a finger ring mounted on the bottom end of said sight adjustment lever in order to accommodate the user to manipulate said lever with a single finger for operating said bow sight.

12. The improved bow sight as set forth in claim 9 above, wherein said sight arm and said sight adjustment lever are in a substantially perpendicular relation when at a rest position and moveable between an acute angle and an obtuse angle during the sighting procedure.

13. The improved bow sight as set forth in claim 9 above, wherein said sight adjustment lever further includes tension adjustment means adapted to adjust the tension of said side adjustment lever relative to said main sight body.

14. The improved archery bow sight as set forth in claim 13 above, wherein said tension adjustment means comprises a tension adjustment lock down nut mounted on said sight adjustment lever and adapted to press said sight adjustment lever on said main sight body to adjust the tension of said sight adjustment lever relative to said main sight body.

15. The improved archery bow sight as set forth in claim 9 above, wherein said main sight body is further provided with an upper stop boss and a lower stop boss and positioned above and below the path of travel of said sight arm to limit the path of travel of said sight arm in conjunction with the path of travel of said peep sight along the length of said curvilinear slotted sight guide between a maximum and a minimum preselected distance.

* * * * *